US005535919A

United States Patent [19]

Ganzer et al.

[11] Patent Number: 5,535,919

[45] Date of Patent: Jul. 16, 1996

[54] APPARATUS FOR DISPENSING HEATED FLUID MATERIALS

[75] Inventors: Charles P. Ganzer, Cumming; Timothy M. Hubbard, Canton; Taiwo T. Osinaiya, Stone Mountain; Paula E. Ruse, Norcross; John T. Walsh, Duluth, all of Ga.

[73] Assignee: Nordson Corporation, Westlake, Ohio

[21] Appl. No.: 331,906

[22] Filed: Oct. 31, 1994

Related U.S. Application Data

[63] Continuation-in-part of Ser. No. 144,893, Oct. 27, 1993, Pat. No. 5,375,738.

[51] Int. Cl.[6] ..... B67D 5/62

[52] U.S. Cl. ..... 222/1; 222/146.5; 222/504; 251/129.19; 335/219; 335/300

[58] Field of Search ..... 222/1, 146.5, 504, 222/559, 146.2; 335/219, 300, 301; 251/129.1, 129.15

[56] References Cited

U.S. PATENT DOCUMENTS

| | | |
|---|---|---|
| D. 354,295 | 1/1995 | Walsh et al. . |
| D. 354,296 | 1/1995 | Walsh et al. . |
| 1,504,773 | 8/1924 | Marston . |
| 2,114,961 | 8/1934 | Gille . |
| 2,860,850 | 5/1953 | Rhodes et al. . |
| 3,212,715 | 10/1965 | Cocks . |
| 3,250,293 | 5/1966 | Adams et al. . |
| 3,329,347 | 7/1967 | Montgomery . |
| 3,408,008 | 10/1968 | Cocks . |
| 3,422,850 | 1/1969 | Caldwell . |
| 3,463,363 | 8/1969 | Zelna . |
| 3,485,417 | 12/1969 | Cocks . |
| 3,521,854 | 7/1970 | Leiber et al. . |
| 3,531,080 | 9/1970 | Dillon . |
| 3,593,241 | 7/1971 | Ludwig . |
| 3,670,274 | 6/1972 | Ellison . |
| 3,702,683 | 11/1972 | Sturmer . |
| 3,704,833 | 12/1972 | Wheat . |
| 3,705,692 | 12/1972 | Garnier . |
| 3,732,893 | 5/1973 | Ziesche et al. . |

(List continued on next page.)

FOREIGN PATENT DOCUMENTS

| | | |
|---|---|---|
| 0063952 | 11/1982 | European Pat. Off. . |
| 2207435 | 6/1974 | France . |
| 6014678 | 1/1985 | Japan . |

OTHER PUBLICATIONS

Nordson® E–700 Electric Gun, Jun. 1991.

Nordson Corporation Dwg. 00109558; Ref. Dwg. Gun, Electric E–700.

Spraymation, Inc.; Electromatic XX, Multiple Outlet Hot Melt Adhesive Applicator.

Spraymation, Inc.; Thermopulse Electromatic V, Heated Solenoid Operated Dispensing Head.

Magnetic Circuits and Transformers; p. 95; Massachusetts Institute of Technology; By Members of the Staff of the *Department of Electrical Engineering*.

Plast–O–Matic Valves, Inc.; Digest Catalog 20; Apr. 1992; Quality Engineered Thermoplastic Valves & Controls.

Spraymation, Inc.; Electromatic XV, Solenoid Operated Extrusion Head & Spray Gun.

Spraymation, Inc.; Exclusive Electromatic Head.

*Primary Examiner*—Kevin P. Shaver

*Attorney, Agent, or Firm*—Raymond J. Slattery III

[57] ABSTRACT

An electromagnetic dispenser for dispensing viscous heated fluids, such as hot melt adhesives. A fixed pole extends from a fluid chamber. The coil is located about a portion of the fixed pole and spaced from the fluid chamber to isolate the coil from the fluid flow path of the adhesive. The coil is insulated from the heat which is conducted from the adhesive as well as provided with a heat sink for dissipating heat. A plunger is mounted within the fluid chamber for reciprocal movement therein to open and close dispensing orifice in response to the field generated by the coil. When mounted to a service block, the coil assembly may be serviced without disconnecting the dispenser body from the source of heated fluid.

29 Claims, 10 Drawing Sheets

U.S. PATENT DOCUMENTS 3,811,601 5/1974 Reighard et al. .
3,827,604 8/1974 Hamilton et al. .
3,833,015 9/1974 Kneuer .
3,876,177 4/1975 Putschky .
3,921,670 11/1975 Clippard et al. .
3,936,030 2/1976 Putschky .
3,965,377 6/1976 Carbonneau .
4,007,880 2/1977 Hans et al. .
4,153,890 5/1979 Coors .
4,218,669 8/1980 Hitchcock et al. .
4,295,631 10/1981 Allen .
4,437,488 3/1984 Taggart et al. .
4,453,652 6/1984 Merkel et al. .
4,488,665 12/1984 Cocks et al. .
4,531,679 7/1985 Pagdin .
4,722,364 2/1988 Kubach et al. .
4,779,838 10/1988 Greiner et al. .
4,951,917 8/1990 Faulkner .
4,962,871 10/1990 Reeves .
4,969,602 11/1990 Scholl .
4,981,280 1/1991 Brandenberg .
4,981,281 1/1991 Brundage et al. .
5,010,911 4/1991 Grant .
5,022,629 6/1991 Tibbals .
5,027,976 7/1991 Scholl et al. ..... 222/146.5 X
5,054,742 10/1991 Nicolaisen .
5,178,332 1/1993 Tsukakoshi et al. .
5,192,936 3/1993 Neff et al. .
5,375,738 12/1994 Walsh et al. ..... 222/1
5,405,050 4/1995 Walsh ..... 222/504 X
5,407,101 4/1995 Hubbard ..... 222/146.5

APPARATUS FOR DISPENSING HEATED FLUID MATERIALS

This is a continuation-in-part of application Ser. No. 08/144,893, filed Oct. 27, 1993, now U.S. Pat. No. 5,375, 738, the disclosure of which is hereby incorporated herein by reference in its entirety.

DESCRIPTION OF THE INVENTION

This invention is directed to a fluid dispenser, such as for the dispensing of viscous fluids, such as adhesives, sealants and caulks. More particularly, this invention is directed to an electromagnetically actuated fluid dispenser for dispensing heated fluid materials such as, for example, hot melt adhesives.

It is common in the dispensing of adhesives to use a pneumatic actuated dispenser, whereby a supply of air is used to move a plunger in reciprocal movement, such that a shutoff needle connected to the plunger is moved from or moved to a seat to permit or stop the dispensing of a pressurized fluid adhesive. To overcome deficiencies of pneumatic dispensers, electromagnetic dispensers have been developed wherein a plunger is driven open by an electromagnetic field and closed by a spring biasing means.

When the coil of an electromagnetic dispenser is energized, the current passing therethrough generates heat due to the resistance of the windings of the coil. Specifically, the heat generated is a function of the current squared and the resistance ($I^2R$) of the windings. As the magnitude of the current passing through the windings increases and/or the length of time the current passing through the windings increases, i.e., longer actuation (on cycle) with a shorter off cycle, more and more heat is generated, thus raising the temperature of the coil. If the heat generated causes the temperature to rise too high, the insulation of the coil may degrade and break down, which may eventually cause the dispenser to fail. This problem is compounded by the fact that in the dispensing of heated fluid materials, such as adhesives commonly known as hot melt adhesives, the fluid material itself may transfer additional heat to the coil. This additional heat increases the temperature of the coil, thus decreasing the allowable temperature rise that can be tolerated by the coil resulting from the current passing through the windings. For example, it is not uncommon for hot melt adhesive application temperatures to be in the range from about 121° C. (250° F.) to about 218° C. (425° F.) or higher. As the application temperature of the adhesive increases, more heat is available to be transferred to the coil. Thus the amount of heat that can be generated by the current passing through the coil in order to avoid exceeding the coil insulation rating is decreased. As such, the allowable energy available to drive the plunger is reduced. This may limit the range of application due to reduced allowable power levels. Furthermore, in some circumstances, the application temperature of the adhesive may even be in excess of the temperature ratings of standard electromagnetic coil designs, making the use of an electrically driven dispenser impractical. On the other hand, hot melt adhesives dispensed at lower temperatures generally transfer less heat to the coil, thus allowing the coil itself to generate more energy (and in turn more heat) before thermal breakdown occurs.

Since the application temperature of the fluid must be maintained, such as to maintain the viscosity of the adhesive at a particular level, heaters are generally provided. Typically cartridge type heaters are provided in the dispenser or the associated service block, thus adding another source which can potentially add heat to the coil.

The problems associated with dissipating the heat generated within the dispenser has resulted in some electromagnetic dispensers being larger than standard pneumatic dispenser. This increase in size does not lend the dispenser to be readily useable in multiple configurations, such as mounting a plurality of dispensers side by side to form a bank of dispensers. In many applications, such as carton sealing, it is desirous to apply a plurality of parallel beads to a substrate on fairly close centers. Standard existing pneumatic guns, such as the Nordson® H200 modules manufactured by Nordson Corporation, are of such a compact size that they are readily adaptable for mounting as a bank of dispensing guns to produce finely spaced beads of material. However, with larger sized electromagnetic guns, it is difficult to apply closely spaced beads of material to substrates. Furthermore, closely mounting multiple electromagnetic guns together further compounds the problem of heating due to the heat transfer from one dispenser to an adjacent dispenser. For example, if three electromagnetic dispensers are mounted together, the two outer dispensers each add an incremental additional amount of heat to the center dispenser. This additional amount of heat may be sufficient enough to affect the thermal characteristics of the center dispenser, thus causing it to fail or vary in operating performance.

It therefore is desirous to produce a compact electromagnetic dispenser, similar in size to the standard pneumatic dispensers, which is capable of operating at fast cycle rates, and is also capable of operating in a bank of dispenser so that closely spaced apart beads of material may be dispensed onto a substrate. Also, it is desirous to produce an electromagnetic gun which is capable of operating not only at fast cycle rates, but is also capable of handling hot melt adhesives, in particular, those in excess of 300° F.

Some existing designs of electromagnetic dispensers require dynamic seals. Dynamic seals are seals in which an object moves therethrough, such as a plunger, and is used to prevent fluid from migrating past the seal. Eventually, a dynamic seal will lose its sealing properties. Once this occurs, the adhesive may migrate into various portions of the dispenser, causing damage or failure thereto. Therefore, it is also desirous to produce an electromagnetic gun which does not require the use of dynamic seals.

Furthermore, it is desirous to prevent or reduce the heat transfer from the fluid material to the coil to thereby minimize the affect of the heated fluid material on the operating characteristics of the coil. This in turn may extend the life of the coil, while expanding its performance capability, such as, for example, allowing it to operate at faster cycles.

Some hot melt adhesive dispensers have attempted to dissipate the heat generated by the coil by transferring it to the heated adhesive. This transfer, if it occurs at all, is not efficient due to a relatively low temperature differential between the fluid and the coil. Also, it is difficult to actually maintain the fluid at a desired temperature. This is because heat is not applied to, nor sensed directly from, the fluid itself. Rather, heat is applied to a portion of the dispenser and transferred to the fluid. Similarly, heat is sensed at a point in the dispenser itself. As such, the fluid temperature must be less than the thermal rating of the coil.

It therefore is desirous to be able to dispense heated hot melt adhesives from an electromagnetic dispenser, wherein the application temperature of the adhesive may be in excess of the insulation rating of the coil.

Also, eventually, the adhesive dispenser will have to be serviced. In the case of an electrically operated dispenser, this would mean disconnecting the electrical connections, as well as disconnecting the dispenser from the supply of pressurized fluid, such as the hot melt adhesive. While in some instances it may be desirous to remove the dispenser completely from a service block or module, there may be circumstances when only a portion of the dispenser needs to be serviced without having to disconnect the supply of fluid to the dispenser. For example, it may only be necessary to service and/or replace the coil of the dispenser, and therefore it would be advantageous to be able to remove the coil from the dispenser without having to remove the entire dispenser from a service block or manifold.

SUMMARY OF THE INVENTION

It is therefore an object of the invention, according to one embodiment of the invention, to provide an electromagnetic dispenser which does not require dynamic seals. This may be accomplished, for example, by providing a movable plunger which is located in a fluid chamber or bore in which the movement of the distal end of the plunger from the valve seat, does not extend beyond the fluid chamber or bore in the retracted position. Eliminating the dynamic seal eliminates a wear part which may fail. Thus the potential problem of the dynamic seal failing and allowing heated fluid material to migrate to the coil is eliminated.

It is also an object of the invention according to one embodiment of the invention, to provide an electromagnetic dispenser which has improved performance characteristics.

It is also an object of the invention according to one embodiment, to provide a means for thermally insulating the means for generating the electromagnetic field from the heat transferred from the heated fluid, thus allowing for the dispensing of heated fluid materials having higher application temperatures. For example, under some circumstances this may allow the use of electrical coils having an insulation rating less than the temperature of the heated fluid. This may be accomplished, for example, by spacing the coil away from the heat fluid material. The coil may be spaced from the fluid chamber or bore and an insulating member placed there between. For example, an air gap may be placed between the coil and the fluid chamber to provide a thermal barrier. Alternatively, an insulating material, such as fiberglass, may be used to provide thermal isolation. Similarly, in order to reduce the heat transferred to the coil, it is preferred that the fluid flow path does not extend into the coil region, i.e. the central portion about which the coils are wound.

It is further an object of the invention, according to one embodiment, to provide for dissipating heat generated by, or transfer to, the means for generating the electromagnetic field. This allows the dispenser to operate at higher power levels and/or at higher fluid application temperatures. This may be accomplished, for example, by a heat sink having a plurality of fins for radiating heat therefrom to the ambient air, thermally coupled to the coil for removing heat from the coil. This reduces the operating temperature of the coil, thereby increasing the efficiency of the coil and providing for improved performance at higher power levels/high cycle rates and/or higher application temperatures.

Up until now, heat sinks have not been used in hot melt dispensers. Since hot melt adhesives are solids at ambient temperatures, they must be heated. As stated previously, heat is applied to the dispenser, either internally or externally, which is then transferred to the adhesive. If the application temperature is exceeded, the adhesive may begin to char which causes the material to produce unwanted solid particulates. If, on the other hand, the temperature falls below the given application temperature, the viscosity of the material will be increased. With increasing viscosity, the fluid material becomes increasingly more difficult to dispense. Changes in viscosity can result in more or less material being deposited onto the substrate, material not being deposited onto the substrate at the appropriate time, the material not shutting off at the appropriate time, and/or improper bonding of the substrate. Also, it is difficult to maintain the appropriate temperature of the hot melt within the dispenser. As a result, the emphasis has been on maintaining the temperature of the adhesive within the dispenser by adding heat and not with the dissipation of such heat from the dispenser to the ambient air.

However, the heat sink provides a means for dissipating the internal heat generated by the coil windings and any heat that may be transferred from the heated fluid material to the windings.

It is also desirous to reduce the vacuum-like attraction force (squeeze film lubrication), that exists between the fixed pole of the coil assembly and the movable plunger, thereby reducing the force necessary to move the plunger to the closed position as well as the time required to close the plunger. This may be accomplished, for example, by providing the movable plunger with an internal flow passage having an opening in the vicinity of the pole/plunger interface.

It is also an object of the invention, according to one embodiment, to provide an electromagnetic dispenser so that the coil of the dispenser may be easily and quickly replaced in the event that it needs to be serviced and/or replaced. This would allow the coil to be quickly replaced in the event that it would fail, while not requiring the dispenser to be disconnected from a manifold or a service block.

It is also an object of this invention according to one embodiment of the invention, to provide a means which can easily and quickly connect/disconnect the electrical connections of the dispenser to a service block, manifold, etc. Such as, providing a plug in dispenser which does not utilize a cord set.

Some of these and other objects and advantages may be accomplished according to one embodiment by an apparatus for dispensing heated fluid materials comprising: a housing defining a fluid chamber, the fluid chamber extending from a first end to an outlet at a second end; a fixed pole disposed at the first end of the fluid chamber and extending away therefrom, wherein a portion of said fixed pole is in fluid contact with the fluid material within the fluid chamber; an inlet means for coupling the fluid chamber to a source of heated fluid material; a coil for generating an electromagnetic field, disposed about a portion of the fixed pole such that a portion of the pole extends beyond the coil to space the coil from the first end of the fluid passageway; and a plunger disposed within the fluid chamber adjacent to the fixed pole and mounted for reciprocal movement therein between closed and retracted positions when subjected to said electromagnetic field, such that when said plunger is in said closed position the outlet is blocked to prevent fluid flow therefrom and in said retracted position fluid flow is emitted from the outlet.

Still further, some of these and other objects and advantages may be accomplished according to an embodiment of the invention by an apparatus for dispensing hot melt adhesive comprising: a housing defining a fluid chamber; an inlet means for coupling the fluid chamber to a source of hot melt adhesive; a fixed pole extending into said fluid chamber such that a portion of an external surface of said fixed pole is in fluid communication with the adhesive; a coil for generating an electromagnetic field, disposed about a portion of the fixed pole and spaced from said fluid chamber; an insulating means, disposed between said fluid chamber and said coil for insulating the coil from the fluid chamber; a plunger disposed within the fluid chamber and mounted for reciprocal movement between a closed position and an open position, said plunger comprising a first portion, having a diameter closely approximating a diameter of the fluid chamber, and a second portion having a reduced diameter and extending from the first portion, the second portion including an engaging means for mating with a surface in the closed position, said plunger being spaced from said fixed pole in said closed position and adjacent to said fixed pole in said open position; at least one bypass flow channel, carried by said housing, for allowing the adhesive to flow past the first portion of the plunger; a means for biasing the plunger in the closed position; a discharge opening coupled to said fluid chamber; and wherein, in response to said electromagnetic field, the plunger moves from the closed to the open position such that adhesive is dispensed therefrom.

Further still, some of these and other objects and advantages may be accomplished according to an embodiment of the invention by an apparatus for dispensing heated fluid materials comprising: housing, adapted for attaching to a service block or manifold, defining a fluid chamber, the fluid chamber extending from a first end to an outlet at a second end, said housing including an inlet means adapted for coupling the fluid chamber to a source of heated fluid material received from the service block or manifold; a fixed pole disposed at the first end of the fluid chamber and extending away therefrom, wherein only an end portion of said fixed pole is in fluid contact with the fluid material; a plunger disposed within the fluid chamber adjacent to the fixed pole and mounted for reciprocal movement therein between closed and retracted positions when subjected to said electromagnetic field, such that when said plunger is in said closed position the outlet is blocked to prevent fluid flow therefrom and in said retracted position fluid flow is emitted from the outlet; a coil assembly for generating an electromagnetic field, disposed about a portion of the fixed pole and spaced from the fluid chamber, the coil assembly being capable of being removed and replaced therefrom without disconnecting the inlet means from the service module or manifold when the housing is attached to the service module or manifold.

Still further, some of these and other objects and advantages may be accomplished according to an embodiment of the invention by the method comprising the steps of releasably attaching a dispenser to a source of pressurized heated fluid and also releasably connecting the dispenser to a source of electrical power; then, at a later time, disconnecting the dispenser from the source of electrical power while maintaining the attachment to the source of heated fluid, to reveal an electrical pole of the dispenser without the heated fluid leaking from the dispenser.

Further still, some of these and other objects and advantages may be accomplished according to an embodiment of the invention by the method of establishing a magnetic gap of an electric dispenser comprising the steps of: assembling a fixed pole to a first body having a cavity therein and disposing a plunger and a spring within the cavity to form a first assembly; inserting the first assembly into a dispenser body until the plunger is fully seated; causing a means to engage both the first body and the dispenser body to prevent further movement therebetween; and then installing a spacer between a nozzle adapter and the dispenser body, the spacer having the same thickness as that of a desired magnetic air gap between an end of the fixed pole and the plunger.

DESCRIPTION OF THE DRAWINGS

The following is a brief description of the drawings in which like parts may bear like reference numerals and in which.

DEFINITIONS

Figure 1:
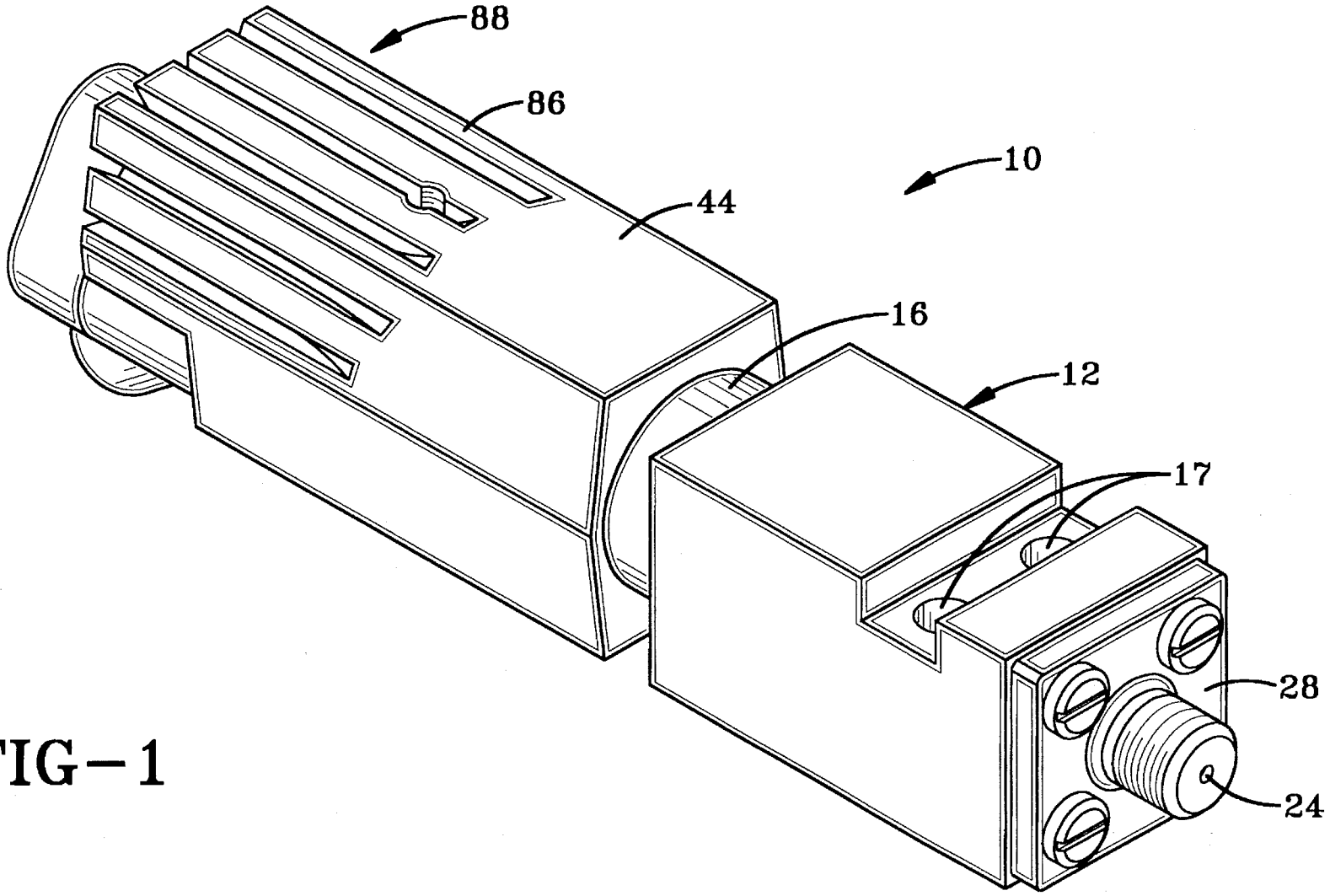
FIG. 1 is a perspective view of a dispenser in accordance with one embodiment of this invention.
Figure 2:
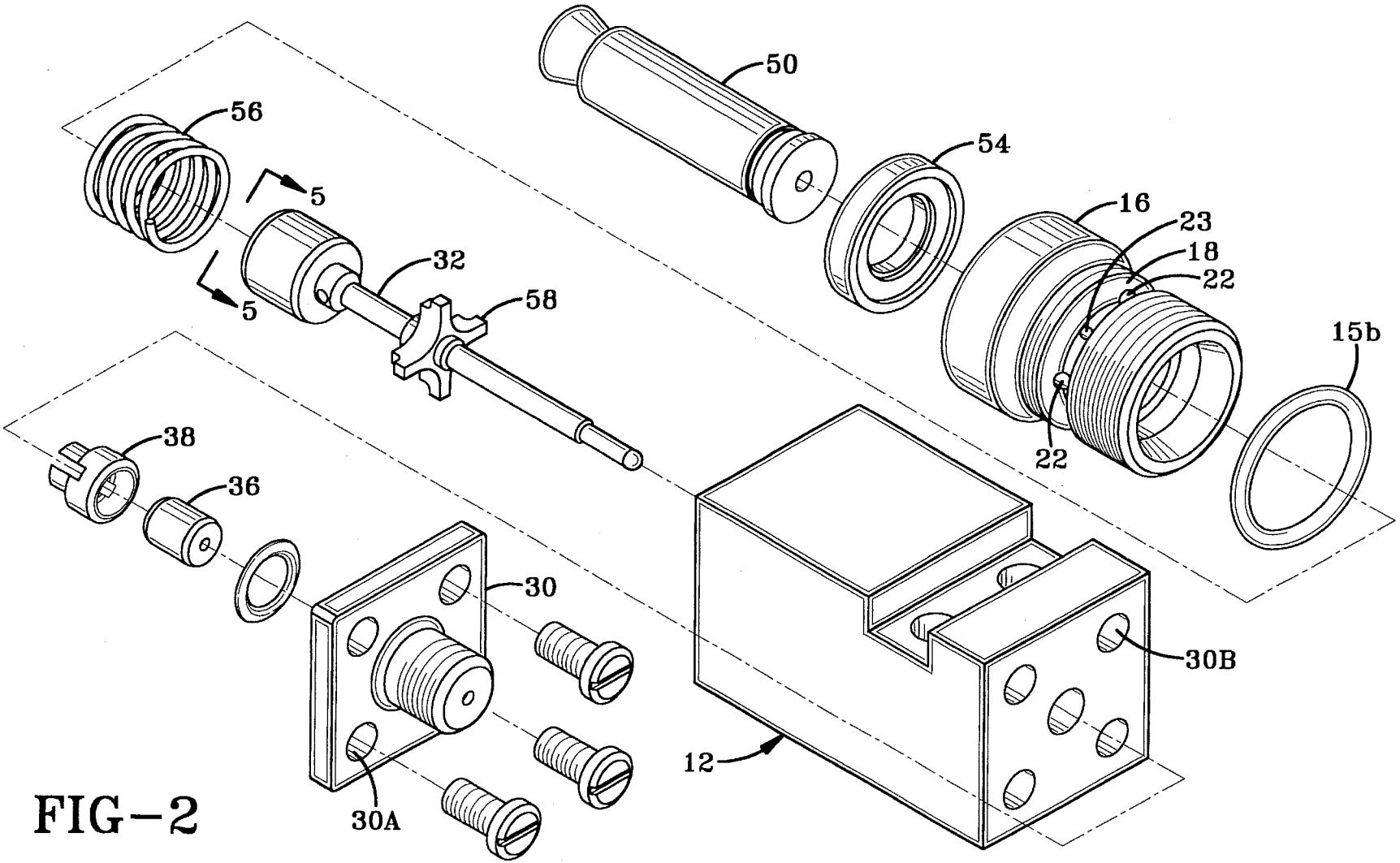
FIG. 2 is a partial exploded view of the dispenser of FIG. 1.

The following definitions are applicable to this specification, including the claims, wherein;

"Axial" and "Axially" are used herein to refer to lines or directions that are generally parallel to the axis of reciprocal motion of the plunger of the dispenser.

"Inner" means directions toward the axis of motion of the plunger and "Outer" means away from the axis of motion of the plunger.

"Radial" and "Radially" are used to mean directions radially toward or away from the axis of motion of the plunger.

DETAILED DESCRIPTION OF THE INVENTION

For the purpose of the present discussion, the method and apparatus of this invention is described in connection with the dispensing of a hot melt polymeric material used in adhesive applications. Hot melt materials are those materials which are solid at room or ambient temperature but, when heated, are converted to a liquid state. It should be understood that the methods and apparatus of this invention are believed to be equally applicable for use in connection with the dispensing of other heated fluid materials.

Now, with reference to FIGS. 1–6, there is illustrated a dispenser, shown generally by reference numeral 10 according to one embodiment of this invention. The dispenser 10 includes a dispenser body 12, having an inlet 14 for receiving a source of fluid material, such as a hot melt adhesive. For example, inlet 14 may be attached to a service module (not shown) having fluid passages therein for supplying fluid and containing heaters and temperature sensors to maintain the temperature of the fluid entering inlet port 14. An O-ring 15*a* mounted within inlet port 14. The dispenser 10 may be mounted to the service block by mounting screws 17.

Mounted within a cavity of the body 12 is an adapter body 16. The adapter body 16 has an outer annular groove 18, which is coupled to the inlet 14. The adapter body and the dispenser body form a fluid chamber 20. An O-ring 15*b* may be used to provide a seal between the adapter and dispenser bodies 16, 12. Fluid is transferred from the annular groove 18 to the fluid chamber 20 by fluid passageways 22 and 23. The fluid chamber 20 is coupled to the discharged outlet 24 via an axially extending fluid passageway 26.

Attached to the dispenser body 12 is a nozzle adapter 28. The nozzle adapter may be mounted to the dispenser body by screws (not shown) extending through openings 30A, 30B, respectively. The outer periphery of the nozzle adapter 28 may have threads 31 for receiving a nozzle, not shown.

Located within the fluid chamber 20 and the fluid passageway 26 is a plunger 32, which is slidably mounted for reciprocal motion. The plunger 32 has a valve needle 34, such as a ball, located at one end of the plunger 32 for mating with a seat 36, located within the nozzle adapter 28, in the closed position. An insert 38 aligns the seat 36 and the nozzle adapter 28 with the fluid passageway 26 in dispenser body 12. Alternatively, the insert 38 may have point guide contacts, for guiding the plunger into the seat 36 as the plunger 32 moves from an open position to a closed position.

An electromagnetic coil assembly 42 is enclosed by housing 44. The electromagnetic coil assembly generates an electromagnetic field when it is subjected to a source of electrical power (not shown). The electromagnetic coil assembly 42 includes a coil 46 comprising a plurality of windings wrapped around a bobbin or spool 48. The windings of the coil 46 may be encased in a potting layer. Preferably this potting material has a high thermal conductivity in order to transfer the heat generated by the coil to the housing 44, for eventual dissipation to the surrounding ambient air.

The spool 48 is located around a pole piece 50 and may be attached to one another, such by potting. The pole piece 50 is generally cylindrical in shape having an end 52 in fluid communication with the fluid chamber 20. Preferably the pole piece 50 extends axially from the spool such that the spool is spaced from the fluid chamber 20. A ring 54 may be located about the periphery of and brazed to, the pole piece 50 to maintain the spacing between the pole piece and the adapter body 16. The interaction of the pole piece 50, ring 54 and the adapter body 16 provide a seal to prevent the flow of fluid material from contacting the spool and in turn the coil 46. It is necessary that the ring 54 is of a material which is non-magnetic so as to help prevent the magnetic field from passing through it. The ring 54 also provides spacing between the coil and the adapter body. It is therefore preferred that the ring 54 does not readily transfer heat therethrough so as not to readily transfer heat to the coil. It has been found that a ring 54 manufactured out of 300 series stainless steel performs these functions adequately. It is also preferred, to provide further insulation between the coil and the heated fluid in order to further limit the transfer of heat to the coil. This can be accomplished by providing an air gap 55 between the ring 54 and the spool 48. For example, the spool 48 may include a raised annular portion 48A to provided spacing between the spool and the ring 54. This spacing results in an air gap directly between the spool and the ringer 54, and indirectly between the spool and the fluid chamber. Thus the windings of the coil 46 are both physically and thermally isolated from the fluid material. As an alternative to utilizing air, other insulation materials, such as fiberglass, for example, can be used to help insulate the coil.

The pole piece 50 is a fixed pole. In other words, when the coil 46 is energized it is not driven axially but is retained in its position. In contrast, the plunger 32 is a movable member.

Upon energization of the coil 46, the generated magnetic field will establish a pole (north or south) on the end 52 of the pole 50. Likewise, a pole of opposite polarity to that established on end 52 of pole 50 will be established on the head 62 of the plunger 32. This will cause plunger 32 to be attracted to the fixed pole 50. As the plunger 32 moves toward the fixed pole 50 the valve needle 34 is moved from the seat 36 which allows the adhesive to be dispensed from the outlet 24. When the coil is de-energized and the field collapses, the plunger 32 will be moved back to the closed position by a spring 56. The spring 56 extends between arms of a retainer 58, attached to the plunger 32, and a shoulder 60 of the adapter body 16.

The head 62 of the plunger 32 has a diameter which closely approximates that of the diameter of the fluid chamber in the portion in which the head 62 slidably moves. This helps to keep the plunger properly aligned as it slides back and forth. While a close fit provides for good guiding of the plunger, it does not provide a good flow path for the material. Therefore, in order to allow for the fluid material to flow past the head, bypass channels 64 are provided in the adapter body.

Causing the fluid to flow past the plunger in this manner helps to prevent dead spots from occurring in the flow of the adhesive through the dispenser. With dead spots, the fluid may begin to solidify to produce undesirable particles or chunks, commonly know as char. Under some circumstances, the flow path through channels 22 and around the plunger head via channels 64, may result in excessive pressure drops across the plunger. In such instances, the pressure drop across the head of the plunger may be reduced by shunting some of the adhesive directly into the fluid chamber 20 from the outer annular groove 18 via channels 23.

When dispensing, the face 70 of the head 62 of the plunger 32 will be adjacent to and/or in contact with the end 52 of the fixed pole 50. Fluid material trapped between face 70 of the plunger head 62 and the end 52 of the fixed pole will contribute to an increase in the force required to begin to move the plunger to the closed position and/or will cause the closing response time to increase. This phenomenon is similar to the increase in force that is required to separate two pieces of glass which have a drop of fluid placed in between them. As used herein, this phenomenon will be referred to as squeeze film lubrication.

It has been previously known to provide a raised annular ring to the face of the plunger in order to minimize the contact area between the plunger and the fixed pole in order to reduce the effect of squeeze film lubrication. See, for example, U.S. Pat. No. 4,951,917 to Faulkner, the disclosure thereof, is incorporated herein by reference. However, while such an annular ring could be employed here, it is believed to be preferable to use several raised portions 72 spaced about the pole face 70 of the plunger 32. Not only does this reduce the squeeze film lubrication force, but also provides a means for reducing the residual magnetism within the plunger. This is accomplished by reducing the cross-sectional area in contact between the pole face 52 of the pole 50 and the face 70 of the head 62 of the plunger 32.

Furthermore, in order to further help reduce the effect of squeeze film lubrication, it has been found to be beneficial to provide a means for introducing a flow of fluid between the pole 50 and the plunger 32 to provide vacuum relief. This may be accomplished by providing the head 62 with fluid flow channels 66, 68. Flow channel 66 extends axially from the face 70, closest to the pole 50. Intersecting with this channel is a radially extending channel 68 which opens into the chamber 20.

As the plunger 32 begins to move toward the closed position fluid will be directed into the openings of fluid channel 68, into fluid channel 66, and eventually into the area 74, which is formed between the fixed pole 50 and the plunger head 62, as well as between the raised portions 72. The introduction of fluid into area 74 from channels 66 and 68 reduces the vacuum like attraction force between the pole and the plunger as the plunger is being driven to the closed position.

Furthermore, this flow path 66, 68 helps in decreasing the response time necessary to move the plunger to the open position. As the plunger moves from the closed to the open position, there is fluid between the head 62 of the plunger and the fixed pole piece 50 which must be displaced. The head, acting much like a piston will displace fluid through the bypass channels 64, as well as through flow channels 66 and 68, and into the fluid chamber 20. Also, the amount of fluid which must be displaced is now the volume of fluid contained within the area 74.

Fixed pole 50 may be provided with a bore 76. Contained within this bore is a non-magnetic material, such as 300 series stainless steel, brass, etc., which effectively prevents the adhesive from traveling into the interior of the fixed pole. The non-magnetic material within the bore 76 helps concentrate the magnetic flux generated by the coil on the pole face 52 of the pole 50 by reducing the cross-sectional area of the magnetic portion of the pole 50 which is perpendicular to the lines of flux. The coil assembly 42 may be retained within the assembly by a set screw 78.

The windings of the coil 46 may be coupled to a source of electrical power by electrical conductors passing through a bore (not shown) to a respective electrical stud, such as illustrated at 80. Each of the studs 80, connect to female couplings 81 carried by an electrical connector 83. The female couplings 81 may be connected to the electrical conductors (not shown) of a cord set extending from port 82. The connector 83 may be retained to the coil housing by a screw 84.

In order to more effectively and efficiently dissipate the heat within the dispenser, it is preferred to provide the dispenser with heat sinks. For example, coil housing 44 may be provided with a plurality of fins 86 for dissipating the heat generated within the dispenser. The fins 86 of the heat sink 88 are thermally coupled to electromagnetic coil assembly 42. In the embodiment viewed in FIG. 3, heat generated by the coil assembly 42 will be thermally transferred through the coil housing 44 and to the fins 86. In that the coil housing 44 directs heat away from the coil assembly 42, it is preferred that it is of a material that is fairly thermally conductive. Furthermore, it is preferred that coil housing 44 is also of a material which will help direct the field generated by the coil 46. In other words, it is preferred that the housing is of a magnetic material, such as a ferromagnetic material. While the heat sink and the housing 44 may be one piece, they could be two separate pieces. For example, a dispenser has been built wherein good results have been obtained with aluminum heat sinks attached to the coil housing 44.

In that it is desirous to keep the heat generated by the coil to a minimum, reducing the magnitude of the current passing through the coil will, therefore, help reduce the amount of heat generated by the coil. Once the plunger has moved to its full open position, the magnitude of the current passing through the coil may be reduced to a lower hold in current. In other words, current may be sent to the coil in order to generate an electromagnetic field which quickly drives the plunger from the closed to the open position. However, once in the full open position, the amount of current required to maintain the plunger at that position is less than it takes to drive it from the closed to the open position. There are several different driving methods which can attain this result. For example, U.S. Pat. No. 4,453,652 (Controlled Current Solenoid Driver Circuit), the disclosure of which is incorporated herein by reference, which is assigned to the assignee of this invention, describes a method of reducing the current flow through a coil once the plunger has moved to its fully extended position. Other current driving schemes could also be used which help reduce the power requirements of the coil.

Figure 7:
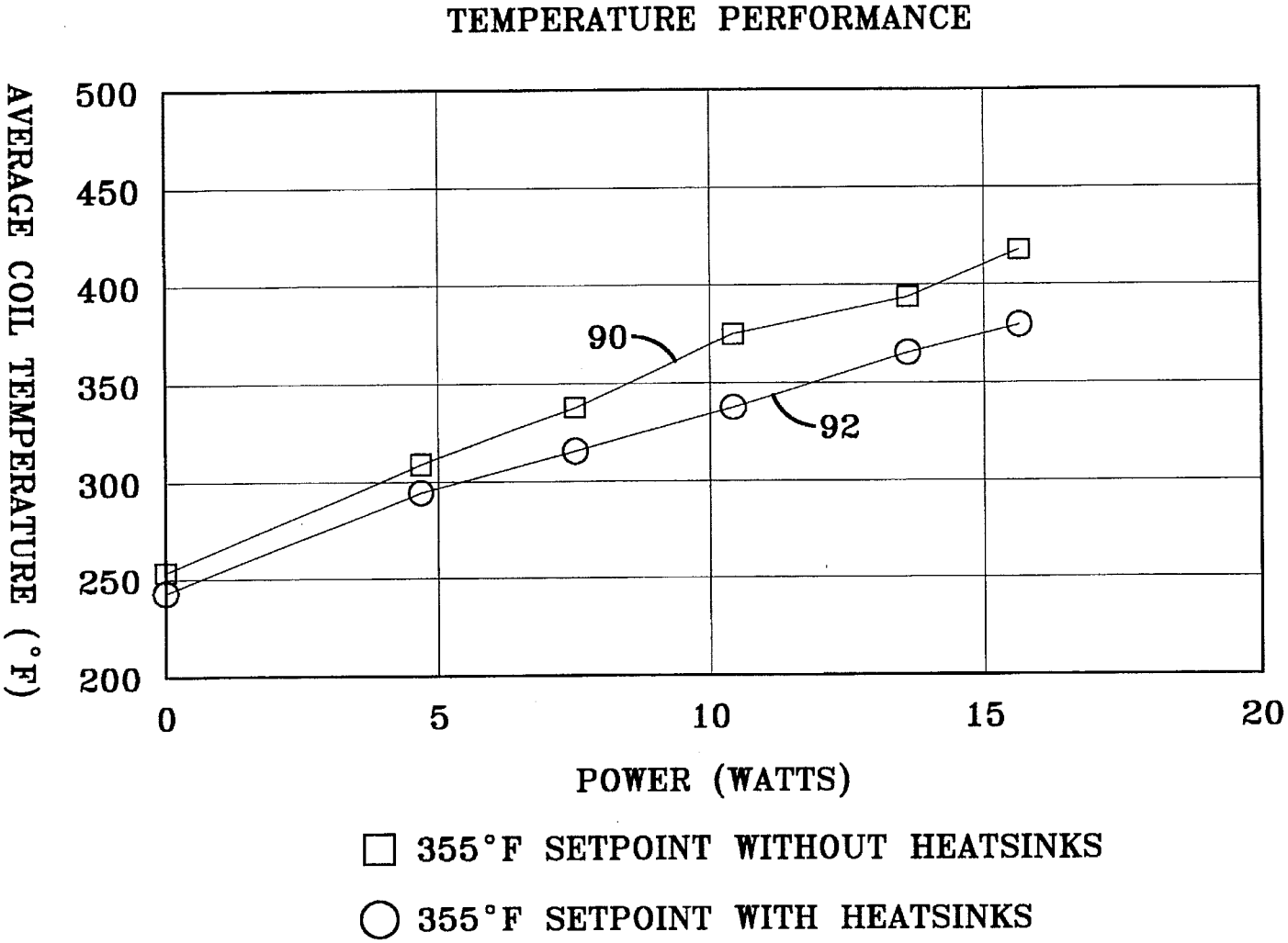
FIG. 7 is a graph of temperature versus power.
Figure 8:
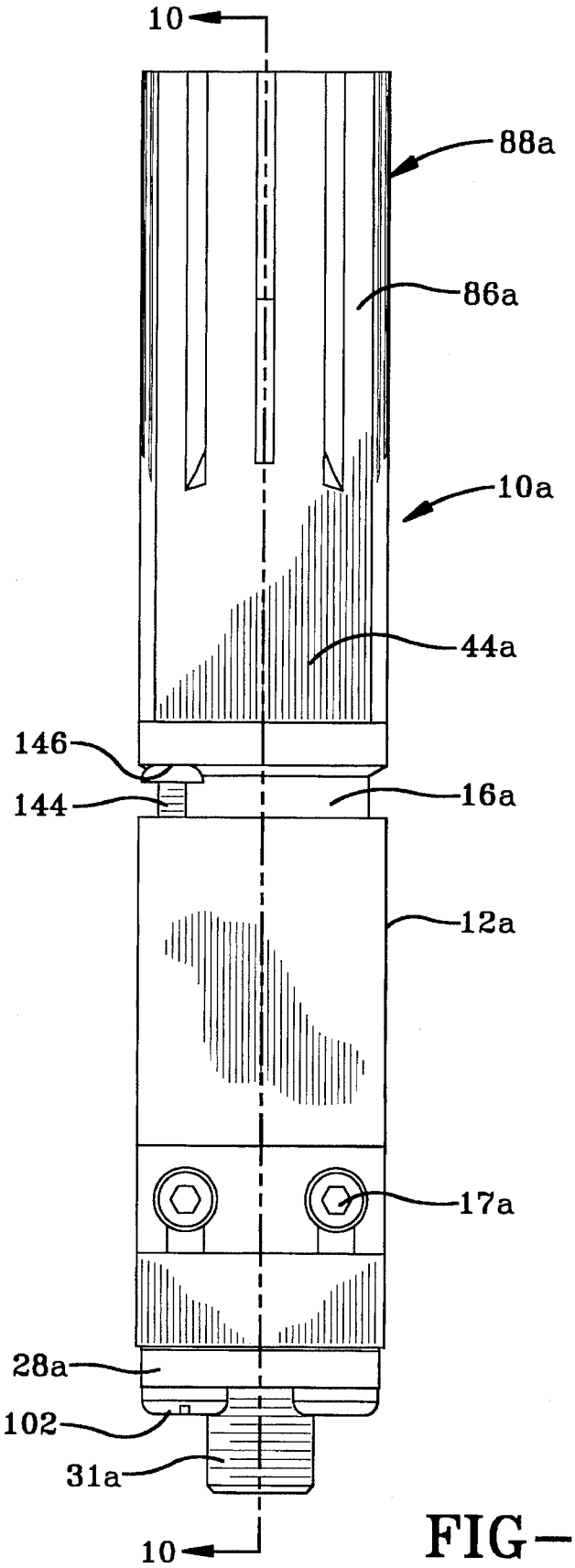
FIG. 8 is a frontal elevational view of a dispenser in accordance with another embodiment of the invention.

An experiment was conducted to compare the heat dissipating characteristics of a dispenser with and without a heat sink. With reference to FIG. 7, there is illustrated a graph of the temperature of the coil of an electric dispenser versus the power utilized by the coil. The electric dispenser according to an embodiment of the invention, was equipped with detachable aluminum heat sinks. The temperature of the coil was monitored at various power levels both with and without the heat sinks attached to the housing of the dispenser. The application temperature of the adhesive during this experiment was 355° F. while the ambient temperature was approximately 70° F. The temperature plotted on each curve is an average of all temperatures taken at that particular power level.

The graph of the temperature without heat sinks is illustrated by line 90 while that of the temperature with heat sinks is illustrated by line 92. As the power of the coil increases, the temperature differential between the two lines becomes generally greater. Thus, at higher power levels, the benefit of the heat sinks becomes more and more apparent. Being able to operate at higher power levels allows the coil to be driven open/closed faster, thereby allowing the dispenser to operate at faster cycle times.

Also, since the plunger is a ferromagnetic material, such as steel, it is preferable to match the thermal expansion coefficient of the various parts which the plunger inter-reacts with, such as the body 12, seat, etc. Due to the heat fluid material and/or its associated heaters, these materials are going to expand. At higher application temperatures this expansion becomes greater. If aluminum is used, for the body, it will expand faster than that of the plunger. This may cause air gap variations. Therefore, it is preferred that the body 12 and the plunger 32 are made from the same materials or from materials which have the same or close coefficients of thermal expansions.

Manufacturing the body 12 and the adapter body 16 out of stainless steel not only helps maintain the magnetic air gap at varying temperatures, but also allows for a more compact unit. In that hot melt adhesive dispensing systems can operate at relatively high pressures, such as for example, between 1000–1500 psi, the bodies 12 and 16 must be able to withstand such pressures. Bodies manufactured from aluminum would require greater cross-sectional areas than those manufactured from steel. As a result, a smaller and more compact unit may be produced by utilizing steel for the bodies 12 and 16.

Now, with reference to FIGS. 8–13, there is illustrated a dispenser, shown generally by reference numeral 10*a* according to another embodiment of this invention. The dispenser 10*a* includes a dispenser body 12*a*, having an inlet 14*a* for receiving a source of fluid material, such as a hot melt adhesive. Inlet 14*a* may be attached to a service module 100 or manifold having internal fluid passages 101 for supplying fluid. An O-ring 15*d* is mounted within inlet port 14*a*. The dispenser 10*a* may be mounted to the service block by mounting screws 17*a*.

Mounted within a cavity of the body 12*a* is an adapter body 16*a*. The adapter body 16*a* has an outer annular groove 18*a*, which is coupled to the inlet 14*a*. The adapter body and the dispenser body form a fluid chamber 20*a*. An O-ring 15*e* may be used to provide a seal between the adapter and dispenser bodies 16*a*, 12*a*. As before, fluid is transferred from the annular groove 18*a* to the fluid chamber 20*a* by fluid passageways 22*a* and 23*a*. The fluid chamber 20*a* is coupled to the discharged outlet 24*a* via an axially extending fluid passageway 26*a*.

Attached to the dispenser body 12*a* is a nozzle adapter 28*a*, which may be mounted to the dispenser body by screws 102 extending through openings 30*d*. The outer periphery of the nozzle adapter 28*a* may have threads 31*a* for receiving a nozzle, not shown.

Located within the fluid chamber 20*a* and the fluid passageway 26*a* is a plunger 32*a*, which is slidably mounted for reciprocal motion and may be constructed as the plunger of 32 of FIGS. 1–6. A seat 36*a* is located within the nozzle adapter 28*a*, while an insert 38*a* aligns the seat 36*a* and the nozzle adapter 28*a* with the fluid passageway 26*a* in dispenser body 12*a*. Alternatively, the insert 38*a* may have point guide contacts, for guiding the plunger into the seat 36*a* as the plunger 32*a* moves from an open position to a closed position. The plunger 32*a* is biased to the closed position by a spring 56*a*.

An electromagnetic coil assembly 42*a* is enclosed by housing 44*a*. The electromagnetic coil assembly generates an electromagnetic field when it is subjected to a source of electrical power. The electromagnetic coil assembly 42*a* includes a coil 46*a* comprising a plurality of windings wrapped around a bobbin or spool 104. The windings of the spool 104 may be provided with an outer wrapping of electrical tape 106, such as Nomex tape. The portion of the bobbin 104 closest to the plunger 32*a* has an end piece 108 which extends radially outwardly. The portion 108 contains two electrical studs 110. These electrical studs 110 connect to the coil wire 112 forming the windings of the coil. In other words, the wire which forms the windings of the coil is attached at one end to one of the studs 110 and is attached at the other end to the other stud. The bobbin is also supplied with two electrical barriers 114 for isolating electrically the studs 110 from conductive members.

A grounding connection, stud 116 is held captive in the housing 44*a*, such as by a pin 118. Grounding stud 116 extends through the base 108 of the bobbin 104 when assembled to ground the housing 44*a*. The electrical coil assembly 42*a* may be encased in a potting layer, so as to affix the coil assembly 42*a* to the housing 44*a*. The potting material, which preferably has a high thermal conductivity in order to transfer the heat generated by the coil to the housing 44*a*, may be for example, an epoxy-based material. With the coil assembly 42*a* bonded to the housing 44*a*, a plug assembly 120 is formed. In other words, studs 110 are electrical conductors, to couple the coil to a source of electrical power while stud 118 is the grounding conductor. The plug assembly 120, in turn, mates with a receptacle assembly 122 carried by the service block 100.

The spool 104 of the electromagnetic coil assembly 42*a* is located around a pole piece 50*a* which is generally cylindrical in shape, having an end in fluid communication with the fluid chamber 20*a*. A ring or spacer 54*a* may be located about the periphery of and brazed to the pole piece 50*a* to maintain the spacing between the pole piece and the adapter body 16*a* and to provide a seal to prevent the flow of the fluid material from contacting the coil assembly. As before, it is preferable that the spool 104 is spaced from the ring or spacer 54*a*. By potting the electromagnetic coil assembly 42*a* to the housing 44*a*, an air gap 55*a* between the ring 54*a* and the spool 104 may be formed without requiring the raised annular portion 48*a* that was required in the spool 48 of the first embodiment. Again, this spacing results in an air gap directly between the spool and the ring 54*a* and directly between the spool and the fluid chamber. Thus additional insulation is provided over and above the function of the insulating portion of ring 54*a*. Therefore, the windings of the coil 46*a* are both physically and thermally isolated from the fluid material. Again, as an alternative to utilizing the air, other insulation may be used.

Within service module 100 are heaters 124, as well as a temperature sensor, such as an RTD, for controlling the operation of the heaters 124. Also, within service module 100 are electrical passageways 128 containing power and control wires (not shown), such as for coupling the electrical receptacle 122 to a source of electrical power in order to actuate or de-actuate the electromagnetic coil assembly 42*a*, providing power to the heaters, etc.

The service module 100 may also contain a thermal barrier 130 disposed between the heaters 124, and the fluid passageways 101 and the temperature sensor 126. This thermal barrier 130 may be an air passageway such that more heat is directed towards the dispenser body 12*a*, as opposed to the temperature sensor 126. The function of the thermal barrier 130 may be more fully described as set forth in U.S. Pat. No. 5,407,101, which is owned by the Assignee of this invention, and in which the disclosure thereof is incorporated herein by reference.

The service module or adhesive manifold 100 may include a mounting block 132 attached to the service block 100 by screws 134. The mounting block 132 may be formed in two half sections 136, 138 which receive a mounting bar 140 therebetween. The bolts 134 when screwed in tighten down against a bar 140 to secure the mounting block 138 and in turn the manifold or service block 100 thereto.

Figure 11:
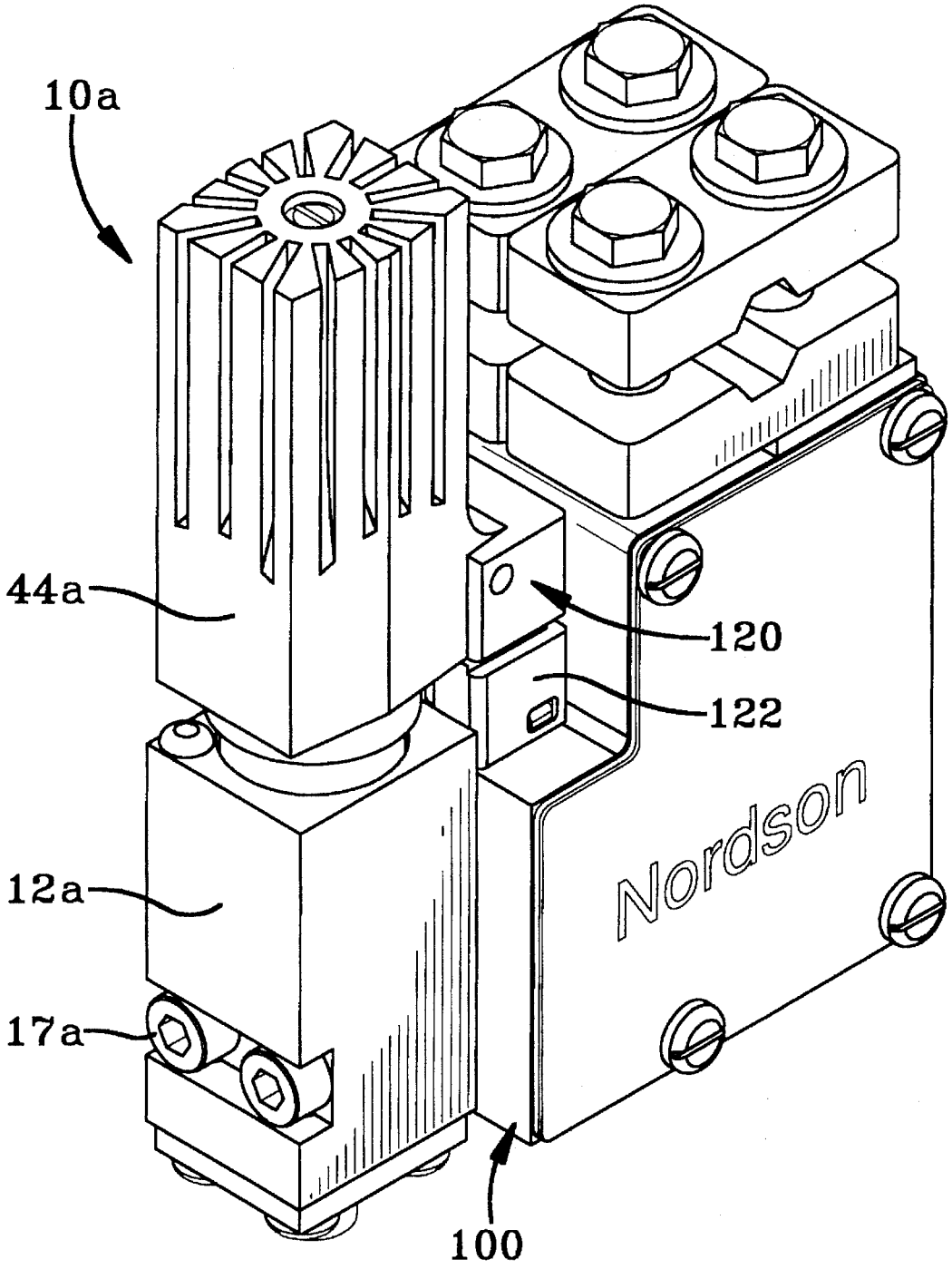
FIG. 11 is a perspective view of the dispenser of FIG. 8 mounted to a service block or module.

In FIG. 11, the dispenser 10*a* is mounted to the service block 100 via screws 17*a* and electrically connected via plug 120 and receptacle 122 of the block 100. In that the electrical components are isolated form the fluid, the coil assembly 42*a* may be serviced or replaced without removing the dispenser body 12*a* from the block 100.

Figures 12, 13:
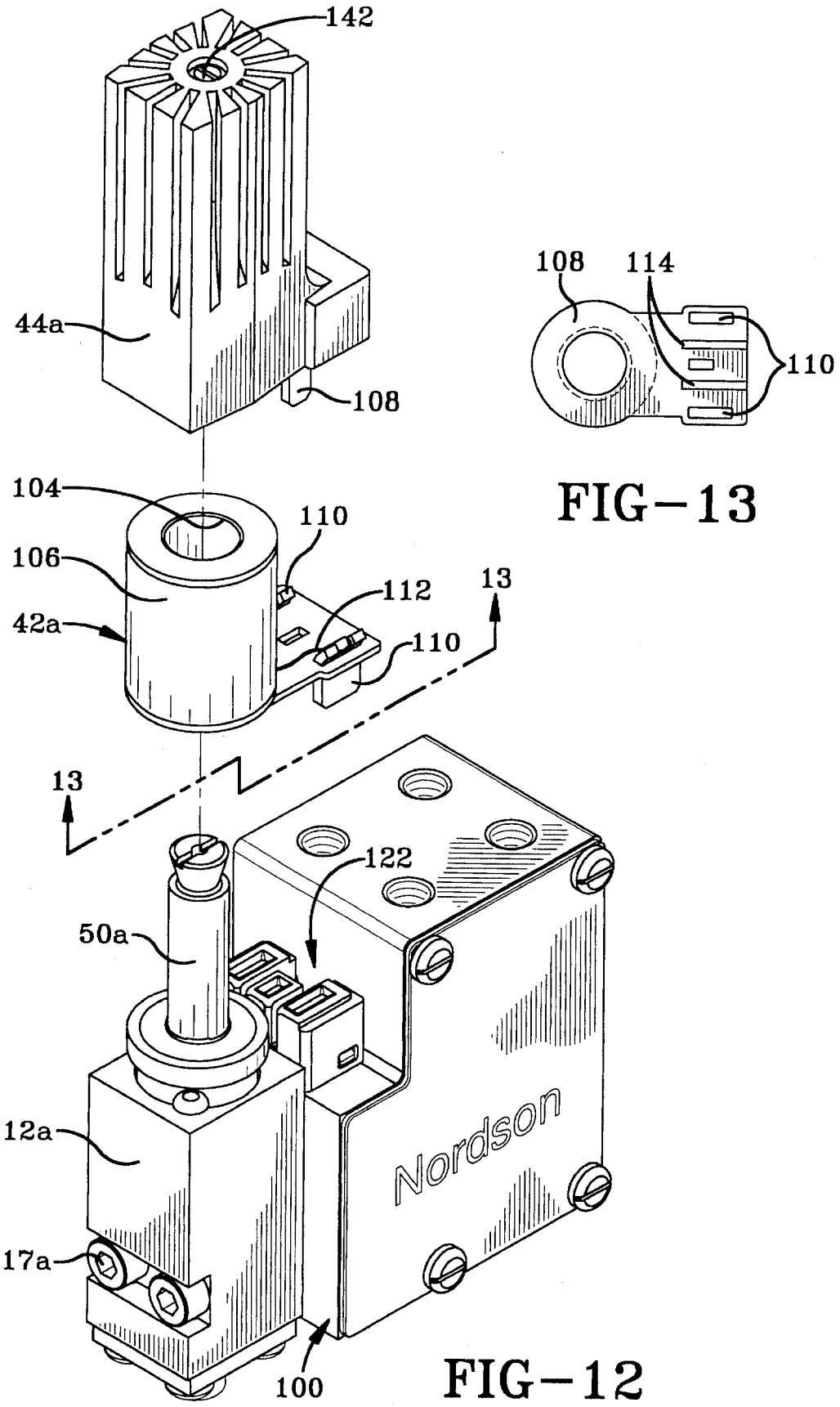
FIG. 12 is a perspective view of the dispenser of FIG. 11 mounted to a service block with the coil housing and the coil assembly removed to expose the pole piece (the mounting block 132 is not shown for clarity)
FIG. 13 is a bottom view of the coil assembly taken substantially along line 13—13 of FIG. 12.

The coil housing 44*a* is attached via bolt 142 which mates with the pole 50*a*. Unscrewing bolt 142 allows the coil housing 44*a* to be slid off of the dispenser assembly. In FIG. 12, the coil housing 44*a* and the coil assembly 412*a* have been removed from the dispenser revealing pole piece 50*a*, while the body 12*a* remains attached to the service block and in turn remains connected to the source of adhesive fluid. In such disassembly, if the coil assembly had been potted to the coil housing 44*a*, the coil assembly would remain within the coil housing. The old coil assembly may be replaced and the old housing reattached or a new assembly, including a new coil housing having a new coil already potted therein, may be then installed. This provides a quick means of changing the coil assembly. Only one bolt is required to be removed and the adhesive connections do not need to be disconnected.

Figure 3:
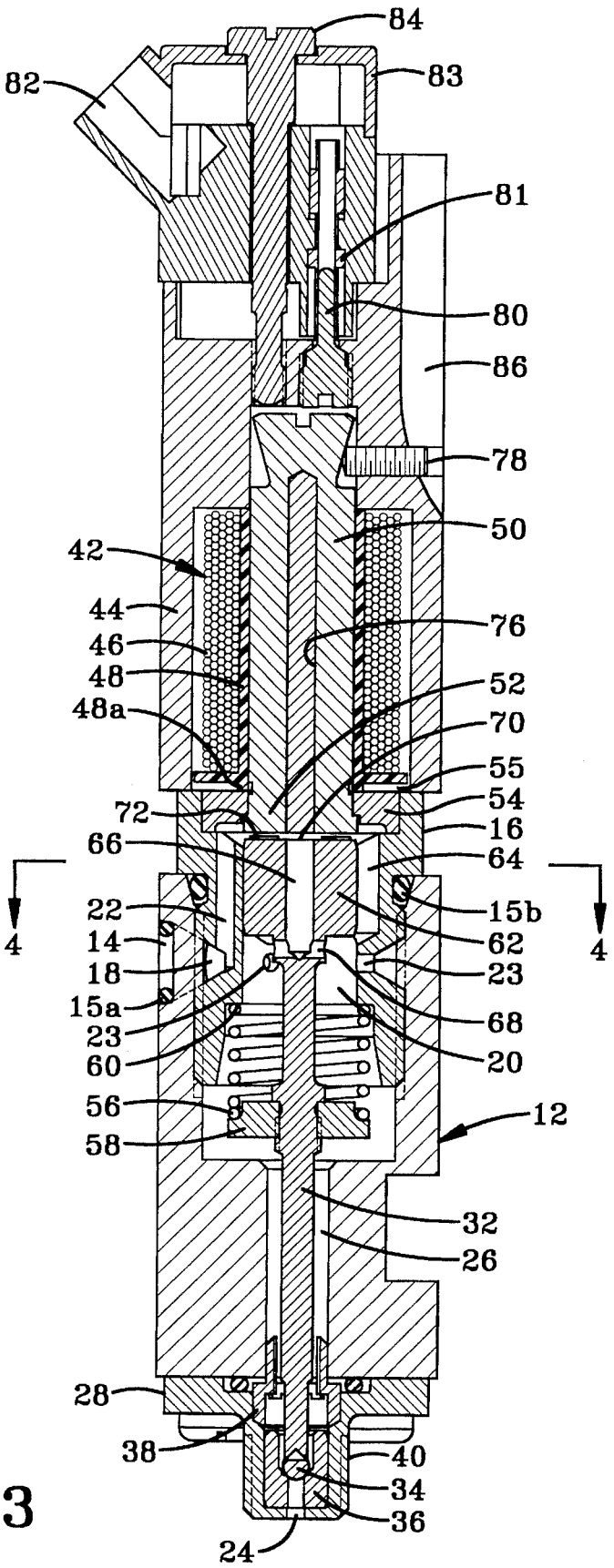
FIG. 3 is an elevational cross-sectional view of the dispenser of FIGS. 1 and 2.
Figure 4:
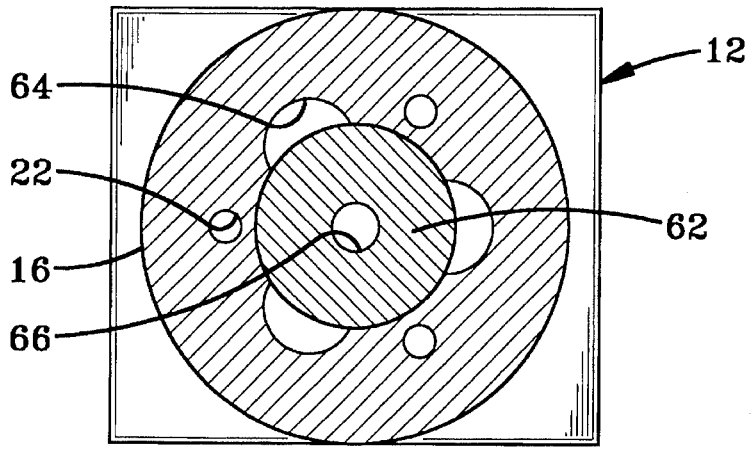
FIG. 4 is a cross-sectional view taken substantially along line 4—4.
Figure 5:
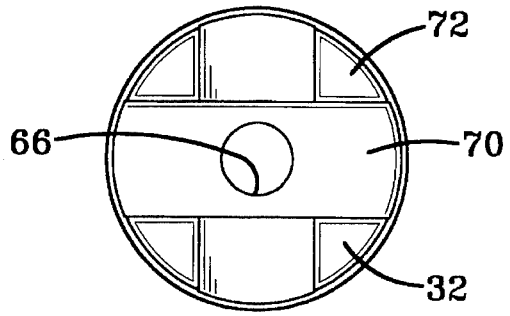
FIG. 5 is an end view of the plunger 32 taken along lines 5—5.
Figure 6:
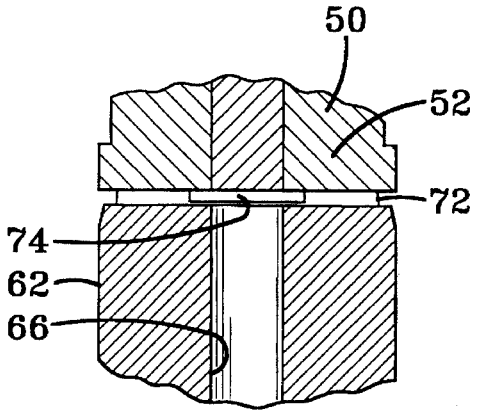
FIG. 6 is an enlarged view of the interface between the fixed pole and the plunger in the retracted position.

Similarly, coil housing 44 of FIG. 3 may be slid off after unscrewing screw 78 and disconnecting the cord set from the electrical connector. This in turn would allow removal of the coil assembly as well as leaving pole piece 50 exposed while body 12 remains attached to a service block or other mounting device containing a source of fluid. Again, this design provides a quick means of changing and/or inspecting a coil assembly without disconnecting the dispenser 10 from the source of pressurized fluid because the flow of adhesive is not through the center of the pole piece 50 as in previous designs.

The operation of this embodiment of FIGS. 8–13 is similar to that of the first embodiment, and as such, upon the energization/de-energization of the coil 46*a*, the plunger 32*a* is open/close thereby causing/preventing the adhesive from being dispensed from the dispenser.

Changes in the magnetic air gap (the distance between the face 70*a* of the plunger 32*a* and the end 52*a* of the fixed pole 50*a*) effect the forces necessary to open or close the plunger, as well as the time necessary to achieve this result.

Figure 9:
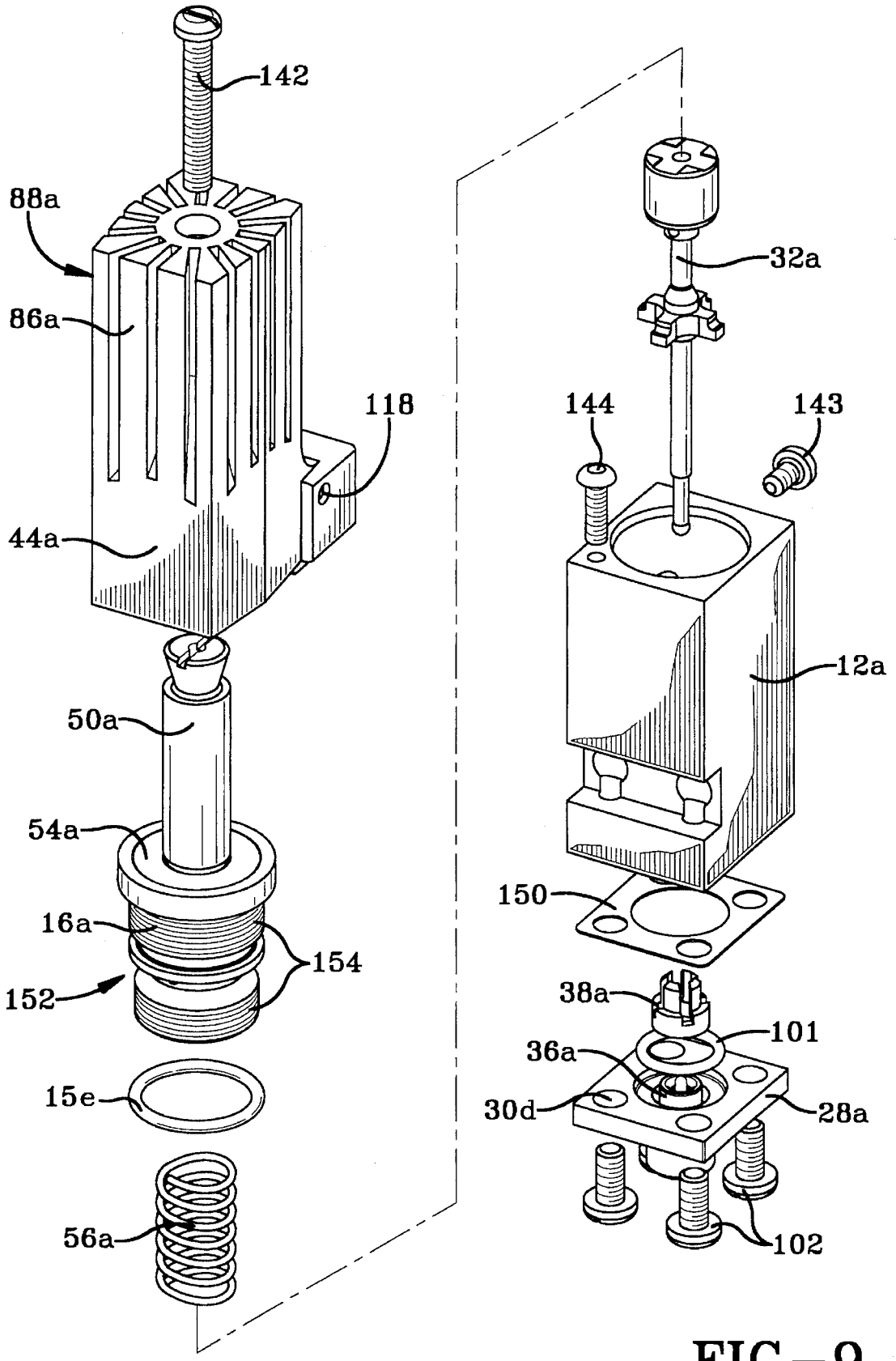
FIG. 9 is a partial exploded view of the dispenser of FIG. 8.
Figure 10:
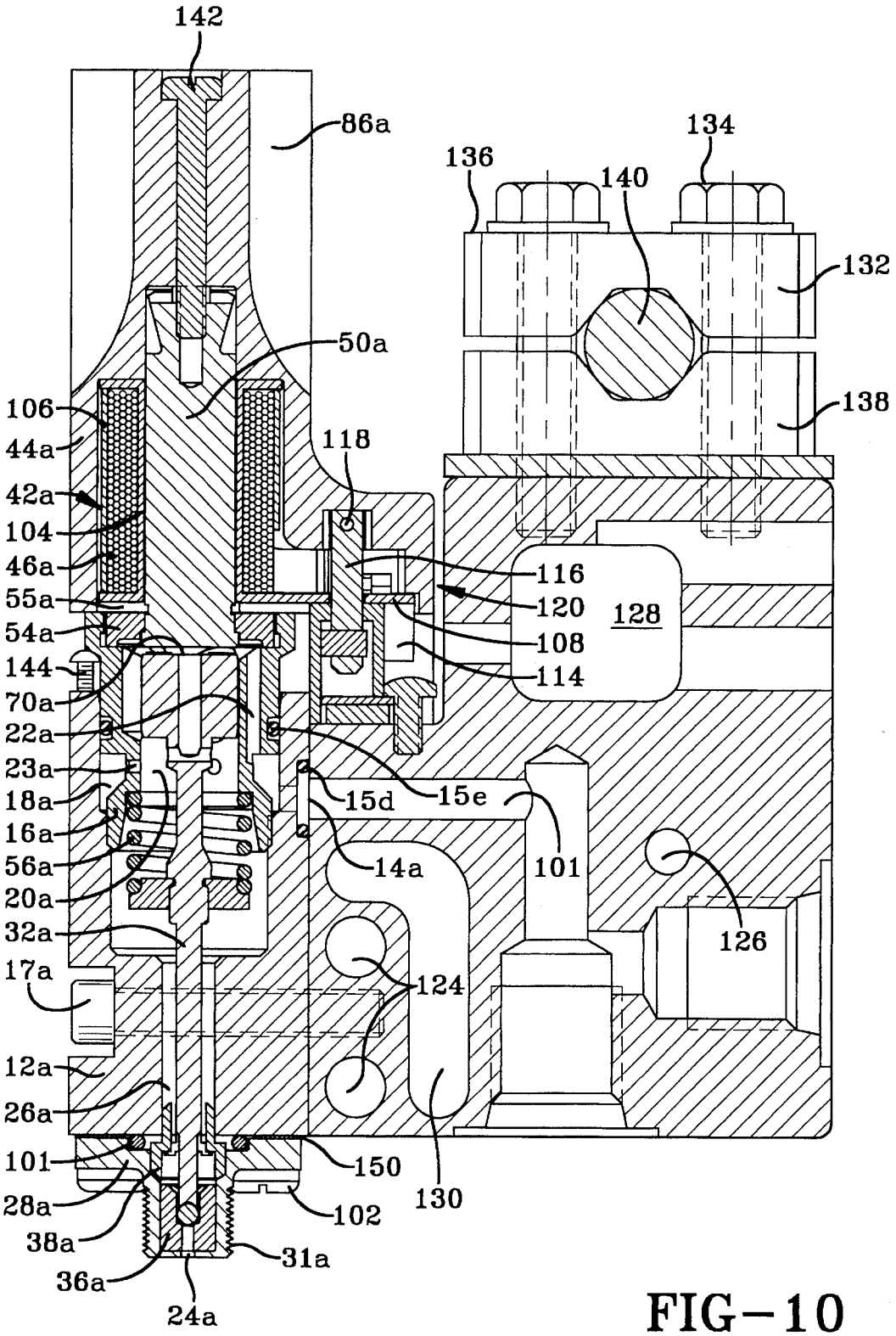
FIG. 10 is an elevational cross-sectional view of the dispenser of FIG. 8 taken substantially along line 10—10.

It has been found that repeatable results may be maintained by utilizing a shim plate during the assembly of the dispenser. With reference to FIG. 9, a shim plate 150 is utilized during the assembly of the dispenser which has the same thickness as the desired air gap. First, seat 36*a*, insert 38*a*, and O-ring 101 are assembled inside of nozzle adapter 28*a*. This assembly is then bolted to the dispenser body 12*a* by screws 102. Then the pole/adapter assembly 152, which includes pole 50*a*, ring 54*a*, adapter body 16*a* and O-ring 15*e*, is inverted and plunger 32*a* and spring 56*a* are located within the cavity of the adapter body 16*a*. This assembly is then inserted into the dispenser body 12*a* and is screwed in until the plunger is fully seated. Locking screw 144 is then backed out of the dispenser body 12*a* until it contacts the tapered edge 146 of the adapter body 16*a*.

As an additional safety feature, a screw 143 extends into the dispenser body 12*a*, and into the cavity containing O-ring 15*e* to prevent the pole/adapter assembly 152 from being removed without first removing the screw 143.

The nozzle adapter 28*a* is then removed from the dispenser body 12*a* by removing screws 102. Gauge plate 150 is installed between the nozzle adapter 28*a* and the dispenser body 12*a*. The nozzle adapter and the gauge plate are now attached to the dispenser body 12*a* by the four bolts 102. Since the assembly had been tightened before until the plunger was firmly seated against the seat 36*a*, the plunger 32*a* will now be spaced from the pole 50*a* by the thickness of the shim plate 150.

It is preferred that the material hardness of the screw 144 is harder than that of the tapered shoulder 146 of the adapter body 16*a*. As such, the force applied to the screw 144 when it is caused to be drawn in contact with the adapter body shoulder 146 should be such that a small dent is formed in the shoulder 146. The formation of this small dent in the tapered shoulder 146 of the adapter body, combined with the opposing axial forces applied to both the adapter body's threads 154 and those of the locking screw 144, provide anti-rotational forces significantly greater than those that should be encountered during assembly or service. This also helps so that the impact forces applied by plunger 32*a* against pole piece 50*a* cannot disturb or tend to loosen the locking adjustment position. Also, the direction of rotation of the locking screw 144 during tightening is preferably counter-clockwise, which tends to rotate the adapter body 16*a* clockwise, which provides a firm contact between the end of the pole 52*a* and the head of the plunger 32*a* such that the final air gap matches the thickness of the shim plate 150.

Again, it is preferred to provide the dispenser with heat sinks. For example, coil housing 44*a* may be provided with a plurality of fins 86*a* for dissipating the heat generated within the dispenser. The fins 86*a* of the heat sink 88*a* are thermally coupled to electromagnetic coil assembly 42*a*. In this embodiment, heat will be transferred through the coil housing 44 and to the fins 86*a* as in the previous embodiment.

In that it is desirous to keep the heat generated by the coil to a minimum, the magnitude of the current passing through the coil may be reduced to a lower hold in current as set forth previously.

While certain representative embodiments and details have been shown for the purpose of illustrating the invention, it will be apparent to those skilled in the art that various changes and modifications can be made therein without departing from the scope of the invention.

It is claimed:

1. An apparatus for dispensing heated fluid materials comprising:

a housing, adapted for attaching to a service block or manifold, defining a fluid chamber, the fluid chamber extending from a first end to an outlet at a second end, said housing including an inlet means adapted for coupling the fluid chamber to a source of heated fluid material received from the service block or manifold;

a fixed pole disposed at the first end of the fluid chamber and extending away therefrom, wherein only an end portion of said fixed pole is in fluid contact with the fluid material;

a plunger disposed within the fluid chamber adjacent to the fixed pole and mounted for reciprocal movement therein between closed and retracted positions when subjected to said electromagnetic field, such that when said plunger is in said closed position the outlet is blocked to prevent fluid flow therefrom and in said retracted position fluid flow is emitted from the outlet;

a coil assembly for generating an electromagnetic field, disposed about a portion of the fixed pole and spaced from the fluid chamber, the coil assembly being capable of being removed and replaced therefrom without disconnecting the inlet means from the service module or manifold when the housing is attached to the service module or manifold.

2. The apparatus of claim 1 further including an electrical connector means carried by the housing and the manifold or service block for releasably coupling the coil assembly to a source of electrical power carried by the manifold or service block.

3. The apparatus of claim 2 wherein the electrical connector means includes a plug means, integral to said housing for mating with a receptacle means carried by the manifold or service block.

4. The apparatus of claim 3 wherein the coil assembly includes a bobbin having an extended portion carrying a pair of electrical studs for coupling the coil assembly to a source of electrical power.

5. The apparatus of claim 4 wherein the housing includes a coil housing releasably secured to said fixed pole, and the coil assembly being disposed within the coil housing.

6. The apparatus of claim 5 wherein the coil housing and the coil assembly are secured by a single fastening means.

7. The apparatus of claim 6 wherein the plug means is adapted to mate with the receptacle or service block axially.

8. The apparatus of claim 5 wherein a heat sink is carried by the coil housing.

9. The apparatus of claim 3 wherein the housing includes a coil housing releasably secured to said fixed pole and having a plurality of external fins and wherein the coil assembly is disposed within the coil housing.

10. The apparatus of claim 1 wherein the plunger includes a head portion having a face adjacent said fixed pole and spaced therefrom in the closed position, the spacing being maintained by a means for locking the fixed pole in place.

11. The apparatus of claim 10 wherein the plunger includes at least one of the following:

a means to reduce squeeze film lubrication forces between said plunger and said fixed pole; and a means for reducing residual magnetism.

12. The apparatus of claim 1 wherein the plunger comprises:

a head portion having a diameter closely approximating the size of the fluid chamber and a reduced portion extending therefrom, the reduced portion including engaging means for mating with a surface in the closed position.

13. The apparatus of claim 1 further including a means for reducing the transfer of heat from the heated fluid material to the coil.

14. The apparatus of claim 10 further including a means for reducing the transfer of heat from the heated fluid material to the coil.

15. The apparatus of claim 1 further including a heat sink means, thermally coupled to said coil for dissipating heat from the coil.

16. The apparatus of claim 4 further including a heat sink means, thermally coupled to said coil for dissipating heat from the coil.

17. The apparatus of claim 1 wherein the housing includes an adapter body releasably secured to a dispenser body;

wherein the fixed pole is carried by the adapter body and is capable of being adjustably spaced from the plunger;

and further including a means for releasably locking the fixed pole to maintain the position thereof.

18. The apparatus of claim 17 wherein the means for releasably locking the fixed pole includes a screw, carried by the dispenser body and adapted for moving into contact with the adapter body.

19. An apparatus for dispensing heated fluid materials comprising:

an inlet means adapted for coupling to a manifold or a service block for receiving heated fluid materials;

a means for generating an electromagnetic field, said means being capable of being removed and replaced without disconnecting the inlet means from the manifold or service block when coupled thereto;

an outlet means, coupled to the inlet means, for dispensing said heated fluid materials therefrom;

a means movable from a first position to a second position in response to the generated electromagnetic field, wherein the dispensing of said heated fluid material is blocked in said first position and wherein said heated fluid material flows from said outlet means in said second position; and a heat dissipating means for removing heat from the means for generating the electromagnetic field.

20. The apparatus of claim 19 wherein said heat dissipating means is a heat sink.

21. The apparatus of claim 20 wherein said heat dissipating means comprises a housing having a plurality of external fins and wherein said means for generating the electromagnetic field is disposed within said housing.

22. The apparatus of claims 20 further comprising means for thermally insulating the means for generating an electromagnetic field from heat transferred from the heated fluid material.

23. In an electrically actuated dispenser, a method comprising the steps of:

releasably attaching a dispenser to a source of pressurized heated fluid and also releasably connecting the dispenser to a source of electrical power;

then, at a later time, disconnecting the dispenser from the source of electrical power while maintaining the attachment to the source of heated fluid, to reveal an electrical pole of the dispenser without the heated fluid leaking form the dispenser.

24. The method of claim 23 wherein the step of disconnecting the dispenser from the source of electrical power includes removing a coil housing of the dispenser.

25. The method of claim 23 wherein the step of disconnecting the dispenser form the source of electrical power includes removing a coil housing and a coil assembly disposed within the coil housing and about the pole piece.

26. The method of claim 24 wherein the coil housing includes a plug for mating with a receptacle coupled to the source of electrical power.

27. The method of claim 24 wherein the coil housing is attached to the electrical pole of the dispenser.

28. The method of establishing a magnetic gap of an electric dispenser comprising the steps of:

assembling a fixed pole to a first body having a cavity therein and disposing a plunger and a spring within the cavity to form a first assembly;

inserting the first assembly into a dispenser body until the plunger is fully seated;

causing a means to engage both the first body and the dispenser body to prevent further movement therebetween; and then installing a spacer between a nozzle adapter and the dispenser body, the spacer having the same thickness as that of a desired magnetic air gap between an end of the fixed pole and the plunger.

29. The method of claim 28 further comprising the steps of claim 23.

* * * * *